United States Patent [19]

Szkaradek

[11] 4,441,658

[45] Apr. 10, 1984

[54] SANDMILL SCREEN MOUNTING ASSEMBLY

[75] Inventor: Edward J. Szkaradek, Santa Ana, Calif.

[73] Assignee: Morehouse Industries, Inc., Fullerton, Calif.

[21] Appl. No.: 321,389

[22] Filed: Nov. 16, 1981

[51] Int. Cl.[3] ..... B02C 17/18

[52] U.S. Cl. ..... 241/46.17; 241/172

[58] Field of Search ..... 241/46 B, 46.11, 46.17, 241/172, 43, 46.15

[56] References Cited

U.S. PATENT DOCUMENTS

| | | | |
|---|---|---|---|
| 3,135,474 | 10/1961 | Schold | 241/21 |
| 3,545,687 | 12/1970 | Mosby et al. | 241/172 X |
| 3,653,600 | 4/1972 | Schold | 241/46.17 X |
| 3,685,749 | 8/1972 | Brown | 241/172 X |
| 3,780,957 | 12/1973 | Wilhelm | 241/172 |
| 3,960,331 | 6/1976 | Szkaradek | 241/46.15 X |
| 4,140,283 | 2/1979 | Szkaradek | 241/46.11 |

FOREIGN PATENT DOCUMENTS

| | | | |
|---|---|---|---|
| 2154713 | 5/1973 | Fed. Rep. of Germany | 241/172 |

OTHER PUBLICATIONS

"Perl Mill" System, Specification Sheet, 10/81.

Specification sheet by Premier Mill Corporation showing a Media Mill.

*Primary Examiner*—Mark Rosenbaum

*Attorney, Agent, or Firm*—Knobbe, Martens, Olson & Bear

[57] ABSTRACT

The upper portion of the liquid processing vessel of a sandmill is provided with a large diameter tubular outlet. A cup-shaped filter to retain the grinding media in the vessel is placed in the outlet, and a cover having an outlet port is placed over the end of the tubular outlet. The filter can be easily removed for cleaning and selectively located in different rotational positions to even wear of the filter.

11 Claims, 4 Drawing Figures

Fig. 1
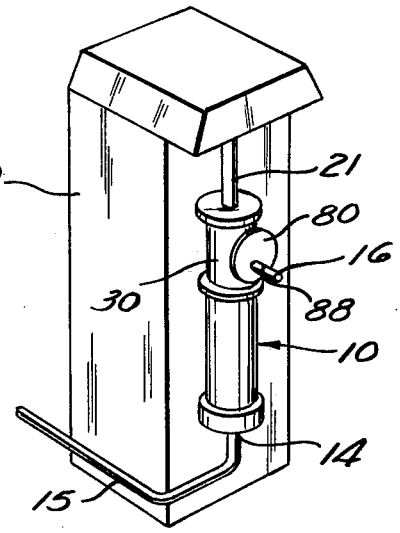
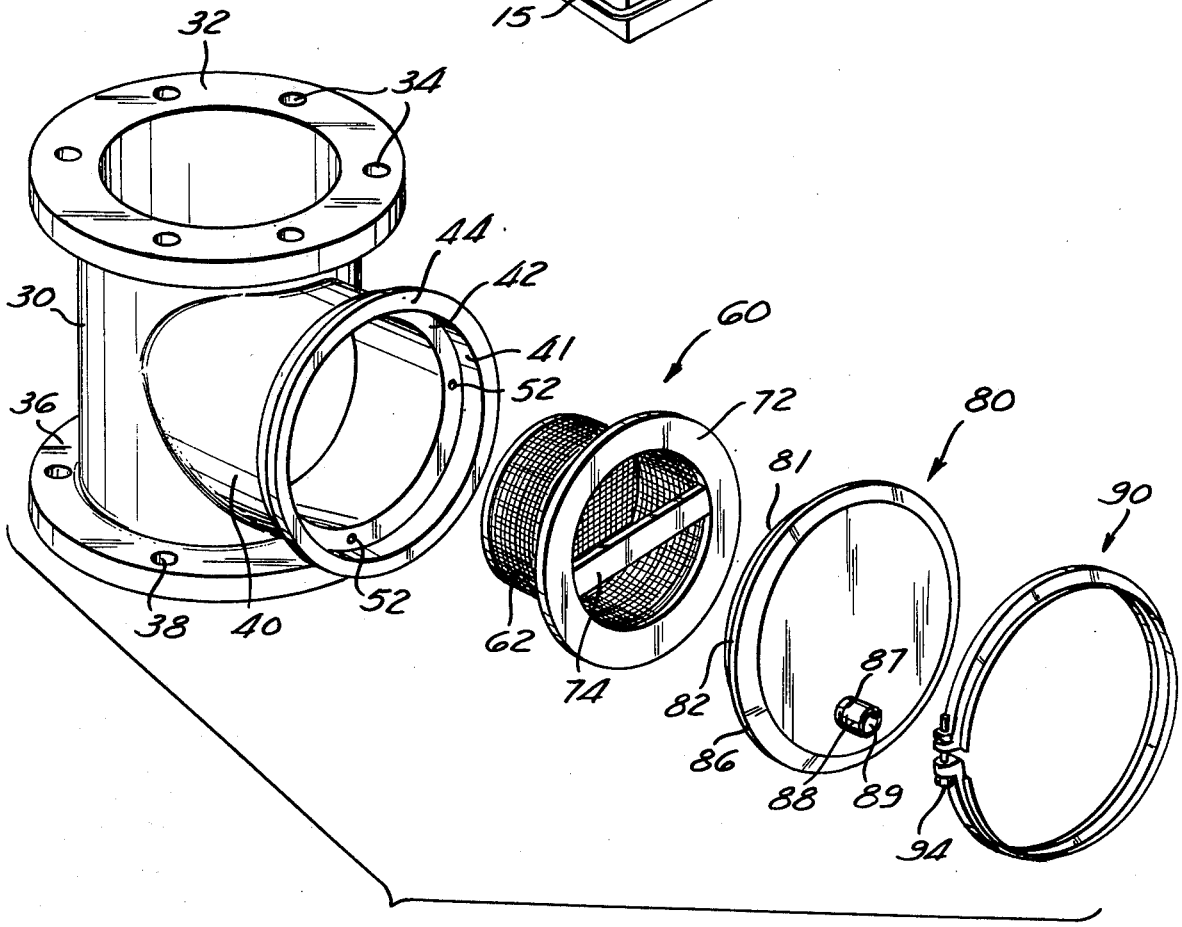
Fig. 2

Fig. 4
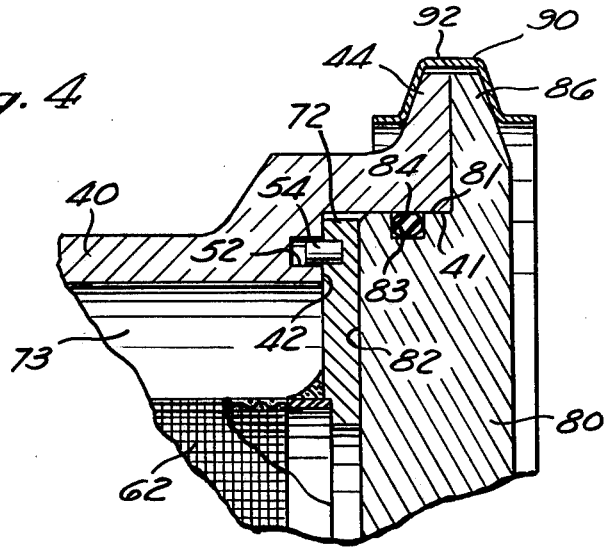
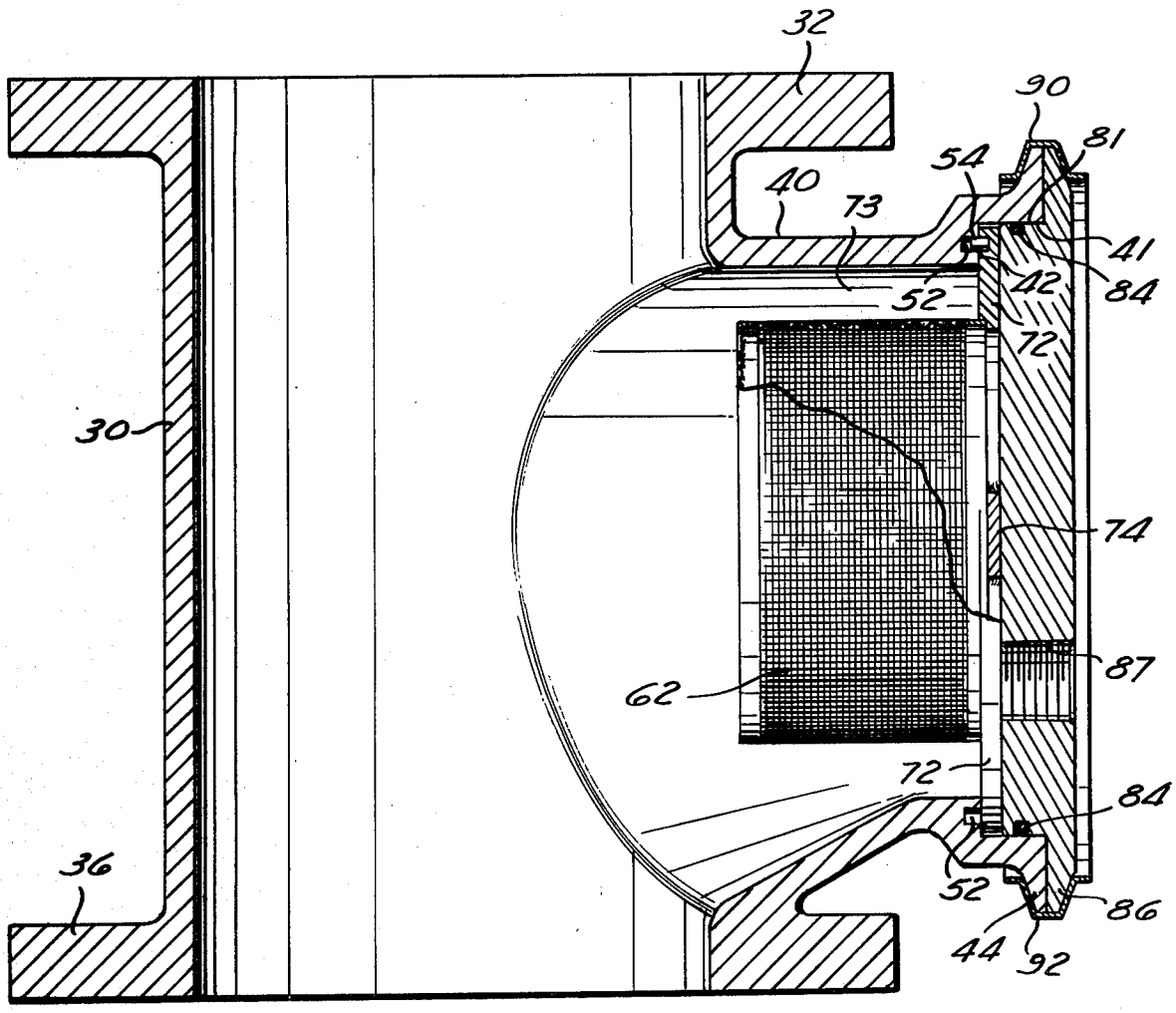
Fig. 3

SANDMILL SCREEN MOUNTING ASSEMBLY

BACKGROUND OF THE INVENTION

This invention relates to an improved arrangement for positioning a filter at the outlet of the liquid processing vessel of a sandmill.

Sandmilling is a proven, practical, continuous, high production method of dispersing and milling particles in liquids to produce smooth, uniform, finely dispersed products. One use of sandmilling is to mill agglomerates in paints. The process is also applicable to the production of a wide variety of inks, dye stuffs, paper coatings, chemicals, magnetic tape coatings, insecticides and other materials in which milling to a high degree of fineness is required.

In a typical sandmilling process, the material or slurry to be processed is introduced at the bottom of a processing chamber or vessel and pumped upward through grinding media, which in years past was usually sand, although currently it is usually a small diameter manufactured product of steel or other material rather than sand. Rotors within the vessel grind the slurry as it is pumped through the media.

Typically, the processed slurry or liquid exits the vessel at its upper end. Since the liquid may contain suspended particles of the grinding media, it is advantageous to place a filtering screen at the vessel's outlet. One such early filtering screen is an annular member attached to the upper portion of the vessel, as disclosed in U.S. Pat. No. 3,135,474 to Schold. In other mills a semi-cylindrical screen is used extending halfway around the vessel near the vessel outlet. Such screens must be removed frequently for removal of media and maintenance. A problem with the typical arrangement is that removal of the filter screen is difficult. A partial solution to this problem has been to provide a large diameter access plate or cover in the side of the vessel, adjacent the screen, so that with the plate removed a brush or other tool can be inserted to attempt to dislodge the media from the exposed portion of the screen. An adequate cleaning cannot be obtained in this manner.

One product on the market merely employs a screen across a large diameter outlet in the side of the vessel. Such screen is removable relatively easily for cleaning, but it has less filter surface than cylindrical, or semi-cylindrical, screens around the rotor. The result of this is that the screen must be cleaned often to prevent undesirably high vessel pressure or reduced flow rate.

Another solution to this problem is disclosed in U.S. Pat. No. 4,140,293 to applicant, in which a cylindrical filter screen and surrounding housing are divided axially into two separate adjoining halves held in place by clamping rings, so the housing and screen halves may be readily separated and removed for cleaning and maintenance without disrupting the remainder of the vessel. While this approach is a significant advance, a need still exists for further improvements.

SUMMARY OF THE INVENTION

The present invention provides a filter screen for the outlet from the liquid processing vessel of a sandmill that is easy to remove for cleaning.

The sandmill of the invention incorporates a large diameter tubular portion at the top of the vessel with a cover plate over the outer end of the tubular portion similar to the access plate referred to above. A filter screen is placed within this outlet tube to ensure that the liquid leaving the vessel is free of particles of the grinding media. The screen is preferrably formed in a cup or basket shape and held in position spaced from the outlet walls, thus providing a large screen surface area, including the bottom wall and the side walls. The cover which holds the screen in the proper position within the outlet tubular portion has a port to provide an outlet for the filtered liquid.

With the cover removed from the end of the tubular outlet, the filter screen is readily accessible and may easily be removed from the outlet tube for cleaning and maintenance. This can be done very quickly, thus reducing the cost of this operation in terms of labor as well as the cost of having the apparatus out of operation. Also, by indexing the orientation of the screen, the screen may be reinstalled in a different position to provide uniform wear.

DESCRIPTION OF THE DRAWINGS

FIG. 1 is a perspective view of a sandmill incorporating the present invention.

FIG. 2 is an exploded perspective view of the screen and cover assembly of the present invention.

FIG. 3 is a side elevation view, partially broken away, of the tubular outlet of a sandmill vessel incorporating the filter of the present invention.

FIG. 4 is a partially cut-away view of the end of the outlet from a sandmill vessel with the present invention installed thereon.

DETAILED DESCRIPTION OF THE INVENTION

Referring to FIG. 1, the sandmill apparatus shown includes a vertical vessel 10 mounted on a support column 20. The vessel has an inlet 14 at its lower end and an outlet 16 near its upper end. Within the vessel 10 there is a plurality of rotors (not shown) mounted on a vertical drive shaft (not shown) which extends through the top of the vessel and through a sleeve 21. The drive shaft is driven by a motor and a system of pulleys contained in the housing 20. Within the vessel is also a grinding media, often referred to as sand, although it is typically a manufactured grit or shot.

The material to be processed by the sandmill is pumped into the inlet 14, upwardly through the vessel 10, and out the outlet 16 by a pump (not shown) on the inlet pipe 15. While the material to be processed is being pumped upwardly through the vessel, the rotors within the vessel are rotated by the drive means. The rotors agitate the grinding media. As the fluid is pumped through the moving media particles within the liquid are milled or ground so the resulting product is very fine and well mixed.

A filter is placed adjacent the outlet 16 to ensure that none of the grinding media that may become suspended in the liquid flows out the outlet 16. In the preferred embodiment shown in FIGS. 2, 3 and 4, a single, generally T-shaped casting 30 forms a segment of the upper portion of the vessel 10. The casting 30 has an upper flange 32 and a lower flange 36, each with apertures 34 and 38 through which bolts or similar attachment means may be passed to secure the casting 30 to the other portions of the vessel 10. Protruding from the side of casting 30 is a tubular outlet portion 40 of approximately the same diameter as the diameter of the main body of the vessel 10. The cross-section is not completely cylindrical in that the lower section 40*a* slopes downwardly and inwardly towards the vessel to prevent media from collecting in that area. While the preferred embodiment of the invention is shown with a single casting forming the upper portion of the vessel, the outlet portion may be formed of a separate casting attached to the upper portion of the vessel.

The outer end of the outlet 40 includes an enlarged cylindrical portion 41 with a flat annular wall or shoulder 42 extending between the portion 41 and the main portion of the tube 40. At the outer end of the portion 41 is an outwardly extending annular flange 44 parallel to the inner shoulder 42. Spaced around the shoulder 42 are small sockets 52, the purpose of which is detailed below. The spacing in the drawing is at approximately 90° intervals.

A filter screen assembly generally designated as 60, fits within the outlet 40. In the preferred embodiment shown in FIG. 2, the filter screen assembly has an outer rim 72 and a cup-shaped filter screen element of suitable, rigid and durable screen or filter material. The outer rim 72 of the filter screen assembly abuts the inner shoulder 42 of the outlet 40 and supports the screen element in the main cavity of the outlet 40. The filter element 62 is spaced inwardly from the surrounding tubular walls, thus forming an annular space or passage 73 through which liquid may flow to enter the cylindrical side wall of the filter. The filter screen assembly 60 additionally includes a crossbar 74, which provides a handle for removing the assembly from the outlet. Referring to FIGS. 3 and 4, a small pin 54 protrudes axially from the inner side of the outer rim 72. This pin 54 fits into any one of the small sockets 52 in the inner shoulder 42 of the outlet tube.

Referring again to FIG. 2, a removable cover, generally designated as 80, fits over the end of outlet 40. The cover 80 has a cylindrical portion 81 that fits with the tubular outer portion 41, and flange 86 that abuts outer flange 44 of the outlet. The cover inner surface 82 abuts the outer rim 72 of the filter screen to hold the filter in position. As can best be seen in FIG. 4, an annular groove 83 and a seal 84 are provided around the periphery of the plate to ensure that none of the liquid flowing through outlet 40 passes between the cover 80 and the outlet. Through cover 80 is a threaded aperture 87. Outlet nozzle 88, threaded on one end, is threaded through this aperture, providing an outlet port 89 through which the filtered liquid can flow.

A circular retaining ring, generally designated as 90, is provided to secure the cover flange 86 to the outer flange 44 of the outlet. The tension of this retaining ring may be adjusted by using threaded adjustment means 94. The main body 92 of the retaining ring 90 is shaped to fit over the perimeters of outer flange 44 and cover flange 86 and hold them together, as shown in FIGS. 3 and 4.

To use the improved filter of the present invention, the filter screen assembly 60 is placed in the outlet 40, with the outer rim 72 abutting the inner shoulder 42 and the pin 54 fitting into one of the small sockets 52. Cover 80 is then mounted with its inner surface 82 abutting the outer rim 72 of the filter screen assembly, and the cover flange 86 abutting the outer flange 44 of the outlet. Circular retaining ring 90 is then placed over flange 86 and flange 44 and tightened with adjustment means 94 to secure the abutting relationship of the two flanges.

As the material to be processed by the sandmill is pumped upwardly through the vessel and into the area the outlet 40, it passes through the end and the cylindrical sidewall of the filter element 62 and out through the port 89. When material deposited on filter element 62 substantially impedes the flow of the material through the screen, the pump is turned off and adjustment means 94 is loosened so circular retaining ring 90 can be removed, releasing cover 80, which is also removed. The handle 74 of the filter screen assembly 60 may then be grasped and the entire filter screen assembly removed from the outlet tube for cleaning. When the filter screen assembly is reinserted into the outlet tube 40, the filter screen assembly may be rotated to a different position by aligning the pin 54 with one of the other sockets 52. In this way, wear of the filter material can be more evenly distributed over the entire surface of the screen element 62.

It should be noted that the shape of the filter provides substantial filter area, greater than cross-section of the tubular outlet in which the filter is positioned. Further, due to the considerable circumference of the screen, the filter area may be easily increased by increasing the axial length of the cup-shaped screen. This is important in that the screen area must be much greater than the diameter of the liquid outlet port because the screen openings are very small and it is desirable that the velocity of the liquid not increase at the entry to the screen. Further, as the screen becomes clogged, the pressure within the vessel increases, which can cause a pressure type mill to be automatically shut down at a predetermined safety level. Frequent shutdown is, of course, undesirable from a cost and lost time standpoint.

I claim:

1. An apparatus for grinding or processing a liquid, having a vertical vessel, with a lower cylindrical segment and an upper cylindrical segment, for receiving grinding media and a liquid to be processed, a motor-driven rotor in the vessel for agitating the media, and a liquid inlet at the bottom of the vessel, the improvement comprising:

a single generally T-shaped casting having a large cylindrical segment forming the upper cylindrical segment of the vessel and having a large tubular liquid outlet portion extending radially outward from the upper cylindrical segment, the outlet portion having an enlarged outer cylindrical end forming an inner annular shoulder facing the end of the outlet portion;

a removable filter screen assembly fitting in the tubular outlet portion and having an annular outer rim that abuts said shoulder;

a removable cover abutting the end of the outlet portion and abutting the outer rim of the filter screen assembly to hold the filter screen assembly in position, the cover having a port providing an outlet for the filtered product; and a circular retaining ring surrounding the cover and the end of the outlet portion for holding the cover against the end of the outlet portion, said screen assembly including a screen having a cup-shape with an open end positioned adjacent the cover, a cylindrical screen side wall spaced inwardly from the surrounding outlet portion, and a screen end wall positioned within said outlet portion adjacent said vessel upper segment.

2. An improved apparatus for grinding or processing a liquid, as defined in claim 1, wherein:

the surface of the inner shoulder has a plurality of circumferentially spaced sockets; and the outer rim of the filter screen assembly has an alignment pin which fits into any of the sockets to angularly locate the filter with respect to the outlet portion.

3. The apparatus of claim 1 wherein said outlet portion has an inner diameter about equal to the inner diameter of said cylindrical segment.

4. In liquid processing apparatus having a generally cylindrical vessel for receiving grinding media and a liquid to be processed, a motor driven rotor in the vessel for agitating the grinding media, means forming a liquid inlet into the vessel through which the liquid to be processed is pumped as the grinding media is agitated by the rotor, means defining a liquid outlet spaced from said inlet, and filter means adjacent the outlet for preventing grinding media from being pumped out of the outlet with the liquid, the improvement wherein:

said liquid outlet has a tubular shape extending generally laterally outward from the vessel, the diameter of the outlet being large relative to the vessel diameter with the outlet having an inner end opening to the interior of the vessel and an outer end extending away from the vessel;

a removable cover closes the outer end of the tubular outlet and has a liquid outlet port therein; and said filter means includes a removable cup-shaped filter element having an open outer end positioned in the outer end of said outlet adjacent said cover surrounding the outlet port, an inner screen end wall positioned in the inner end of the tubular outlet in the path of liquid flowing to said outlet port, and a tubular screen side wall positioned in said tubular outlet, the screen end wall and side wall being spaced inwardly from the inner wall of the tubular outlet to define a space through which liquid may flow on its way to and through the screen side wall to the outlet port, the size of the filter being such that the combined filter area of the screen end and the screen side wall is much greater than the cross section of the tubular outlet, the diameter of the screen side wall being greater than the axial length of the screen side wall.

5. The apparatus of claim 4 wherein the diameter of the tubular outlet is about the size of the cylindrical vessel.

6. The apparatus of claim 4 wherein the tubular outlet and a segment of the vessel are formed as a single, generally T-shaped casting.

7. The apparatus of claim 6 wherein said vessel is vertically oriented such that the outlet extends generally horizontally, and the lower wall of the outlet which joins the vessel slopes downwardly and inwardly to minimize the possibility of grinding the media collecting in that area.

8. The apparatus of claim 4 wherein said outlet has an inner shoulder spaced from the outlet outer end, a surface of the inner shoulder facing the end of the outlet, and the filter screen has an annular outer rim abutting said surface.

9. The apparatus of claim 8 wherein the cover abuts the outer rim of the filter to hold the filter against the inner shoulder.

10. The apparatus of claim 4 wherein the outer end of the outlet has an outwardly extending flange, the cover has a flange abutting the outlet flange and including a circular retaining ring surrounding the cover flange and the outlet flange for holding the cover flange against the outlet flange.

11. The apparatus of claim 4 wherein the outlet has an inner annular shoulder having spaced around it a series of small sockets, and the filter screen has an outer rim engaging said shoulder, and a pin on said rim to be selectively positioned in one of said sockets, whereby the angular position of the filter screen is determined.

* * * * *